US006289772B1

(12) United States Patent
Ying-Wen

(10) Patent No.: US 6,289,772 B1
(45) Date of Patent: Sep. 18, 2001

(54) SPEED WRENCH

(76) Inventor: Pai Ying-Wen, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/627,906

(22) Filed: Jul. 27, 2000

(51) Int. Cl.[7] ..... B25B 13/02

(52) U.S. Cl. ..... 81/119; 81/124.3; 81/125.1; 81/186

(58) Field of Search ..... 81/119, 124.3, 81/125.1, 186

(56) References Cited

U.S. PATENT DOCUMENTS

| | | | | |
|---|---|---|---|---|
| 3,242,775 | * | 3/1966 | Hinkle | 81/119 |
| 3,620,107 | * | 11/1971 | Evans | 81/125.1 |
| 3,757,614 | * | 9/1973 | Evans et al. | 81/119 |
| 3,762,244 | * | 10/1973 | Evans | 81/119 |
| 3,875,828 | * | 4/1975 | Evans | 81/119 |

* cited by examiner

*Primary Examiner*—James G. Smith
(74) *Attorney, Agent, or Firm*—Charles E. Baxley

(57) ABSTRACT

A speed wrench includes an open end having a through portion connected to a shank of the wrench and a first jaw and a second jaw respectively extend from the throat portion. The first jaw has a first flat surface defined in an inside thereof and the second jaw has a second flat surface defined in an inside thereof. A throat recess is defined in the throat portion ad a first recess is defined in the inside of the first jaw, and a second recess is defined in the inside of the second jaw. An end of a periphery defining the second recess is connected to the second flat surface and a 60-degree angle recess is connected between the other end of the periphery of the second recess and the throat recess. A first pushing side is connected between the first flat surface and an end of a periphery defining the first recess. A second pushing side is connected between an end of a periphery defining the throat recess and the other end of the periphery defining the first recess. Four sides of a hexagonal object contact the first pushing side, the second pushing side and two sides composing the 60-degree angle recess.

3 Claims, 6 Drawing Sheets

SPEED WRENCH

FIELD OF THE INVENTION

The present invention relates to a speed wrench which has three recesses separated by two pushing portions one of which is a flat side and the other pushing portion is composed of two surfaces with an angle defined therebetween.

BACKGROUND OF THE INVENTION

A conventional open ended wrench is shown in FIG. 1 and generally includes a shank 10 with two open ends 11 each of which includes two jaws between which a recess 12 is defined. The recess 12 is defined by two pushing sides 13 so that a hexagonal object can be received in between the two jaws and two sides of the object contact the two pushing sides 13. When rotating the wrench, the object is rotated by the two pushing sides 13 and a peak of the hexagonal object is engaged with the recess 12. However, the user has to remove the wrench from the object and engage the object repeatedly to tighten or loosen the object. This is inconvenient for the user to smoothly operate the wrench because it takes too much time to remove the open end from the object and to engage the open end with the object.

The present invention intends to provide a wrench with an open end which has two jaws one of which has an inclined surface and each jaw has a recess defined in an inside thereof. A through recess is defined in a throat portion of the open end and a pushing side connected between the throat recess and one recess in one jaw, and a 120-degree corner is connected between the throat recess and the other recess in the other jaw. The wrench of the present invention can rotate an object reciprocally without removing the wrench from the object.

SUMMARY OF THE INVENTION

In accordance with one aspect of the present invention, there is provided a speed wrench and comprising a shank having an open end on an end of the shank and the open end having a throat portion connected to the shank. A first jaw and a second jaw respectively extend from the throat portion. The first jaw has a first flat surface defined in an inside thereof and the second jaw has a second flat surface defined in an inside thereof. A throat recess is defined in the throat portion and located between the first jaw and the second jaw. A first recess is defined in the inside of the first jaw and a second recess is defined in the inside of the second jaw. An end of a periphery defining the second recess is connected to the second flat surface. A first pushing side is connected between the first flat surface and an end of a periphery defining the first recess, and a second pushing side is connected between an end of a periphery defining the throat recess and the other end of the periphery defining the first recess. A third pushing side is defined in the inside of the second jaw and extends from the other end of the periphery defining the throat recess. A fourth pushing side is connected between the third pushing side and the other end of the periphery defining the second recess. A 120-degree angle defined between the third pushing side and the fourth pushing side. A length of the third pushing side equals to two third of a side of a hexagonal object engaged with the open end and a length of the fourth pushing side equals to one third of a side of a hexagonal object engaged with the open end of the wrench.

The object of the present invention is to provide a wrench that holds a hexagonal object securely and can reciprocally rotate the object without removing the open end from the object.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
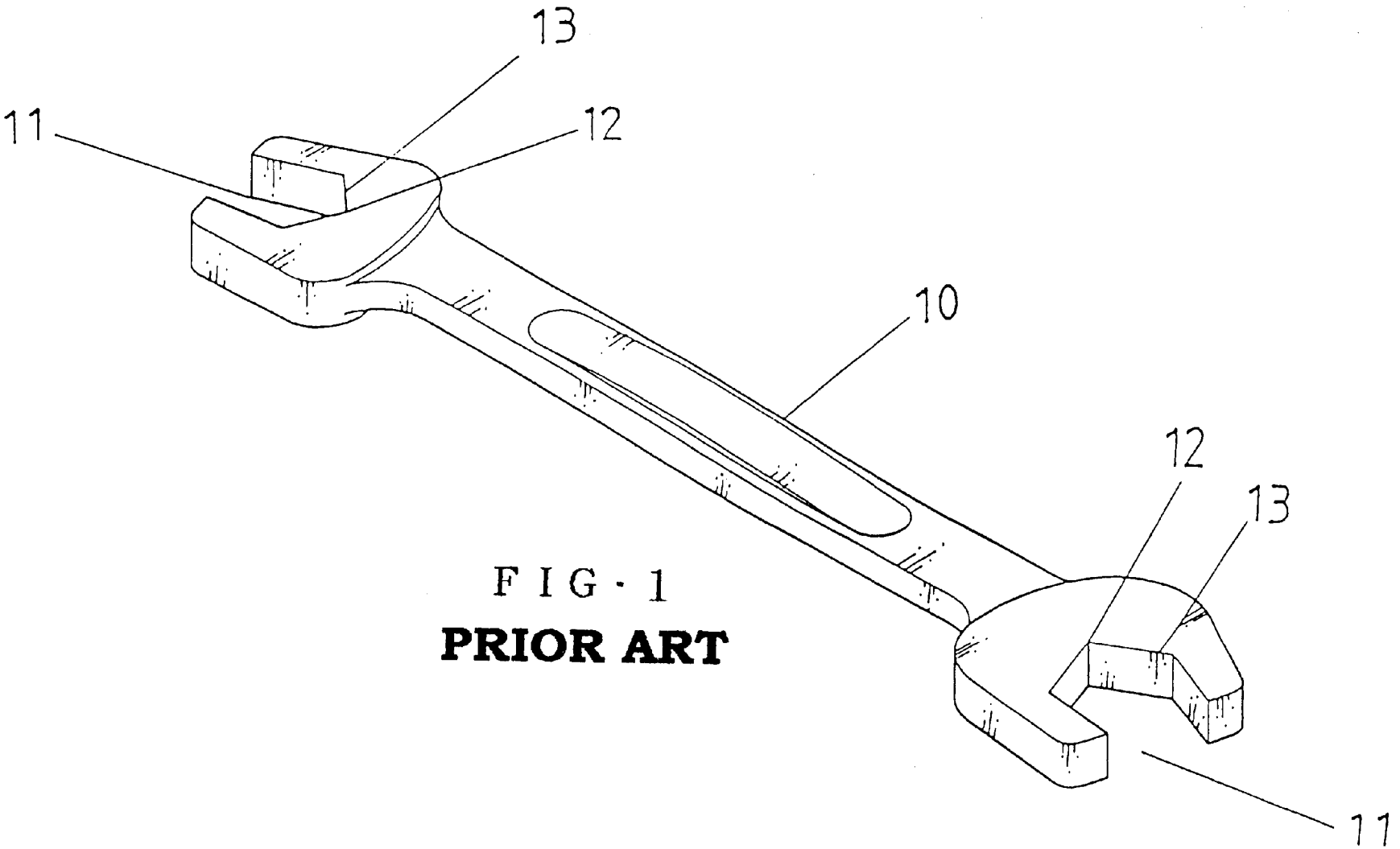
FIG. 1 PRIOR ART
FIG. 1 is a perspective view to show a conventional wrench.
Figure 2:
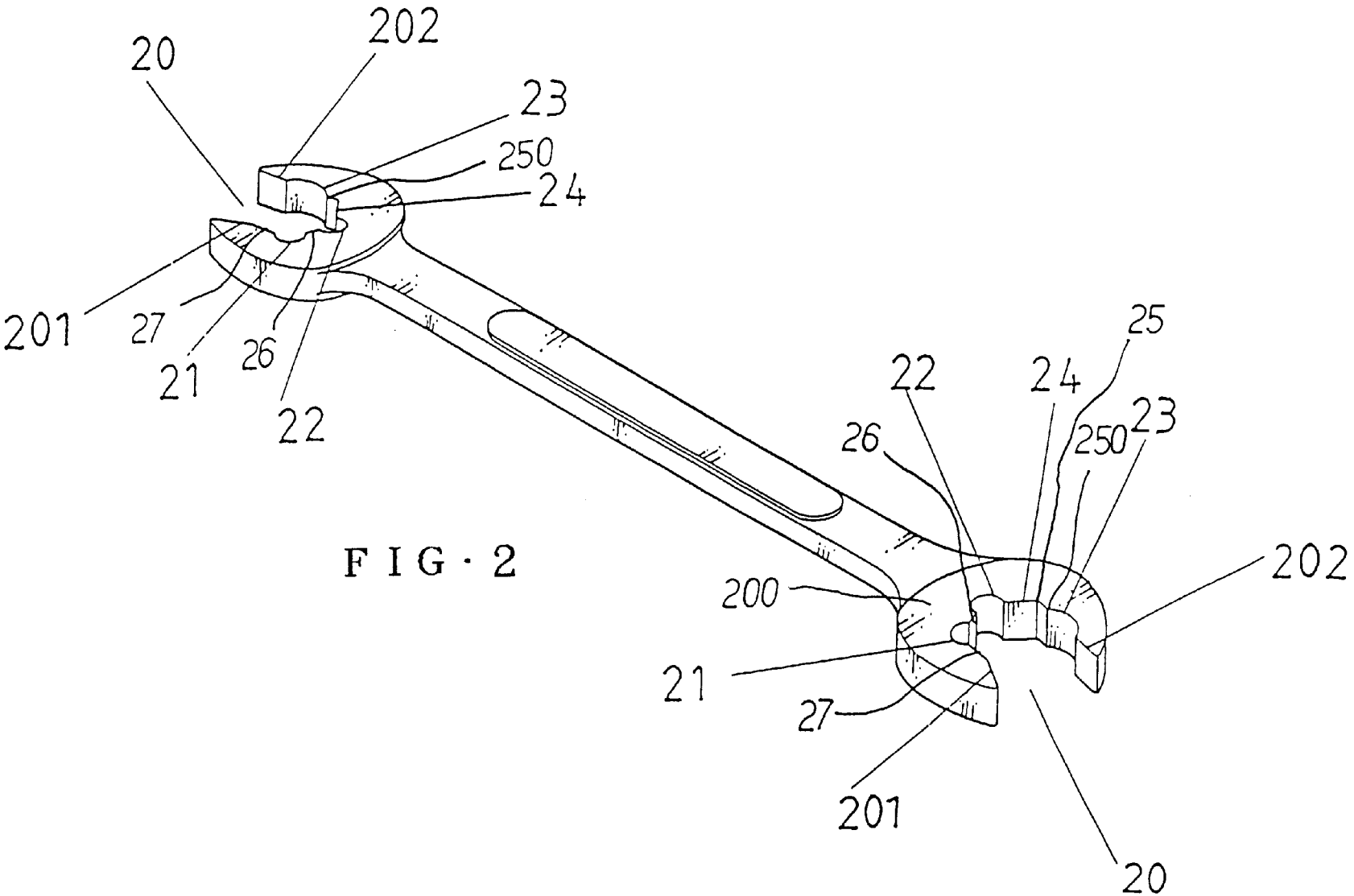
FIG. 2 is a perspective view to show a speed wrench of the present invention.
Figure 3:
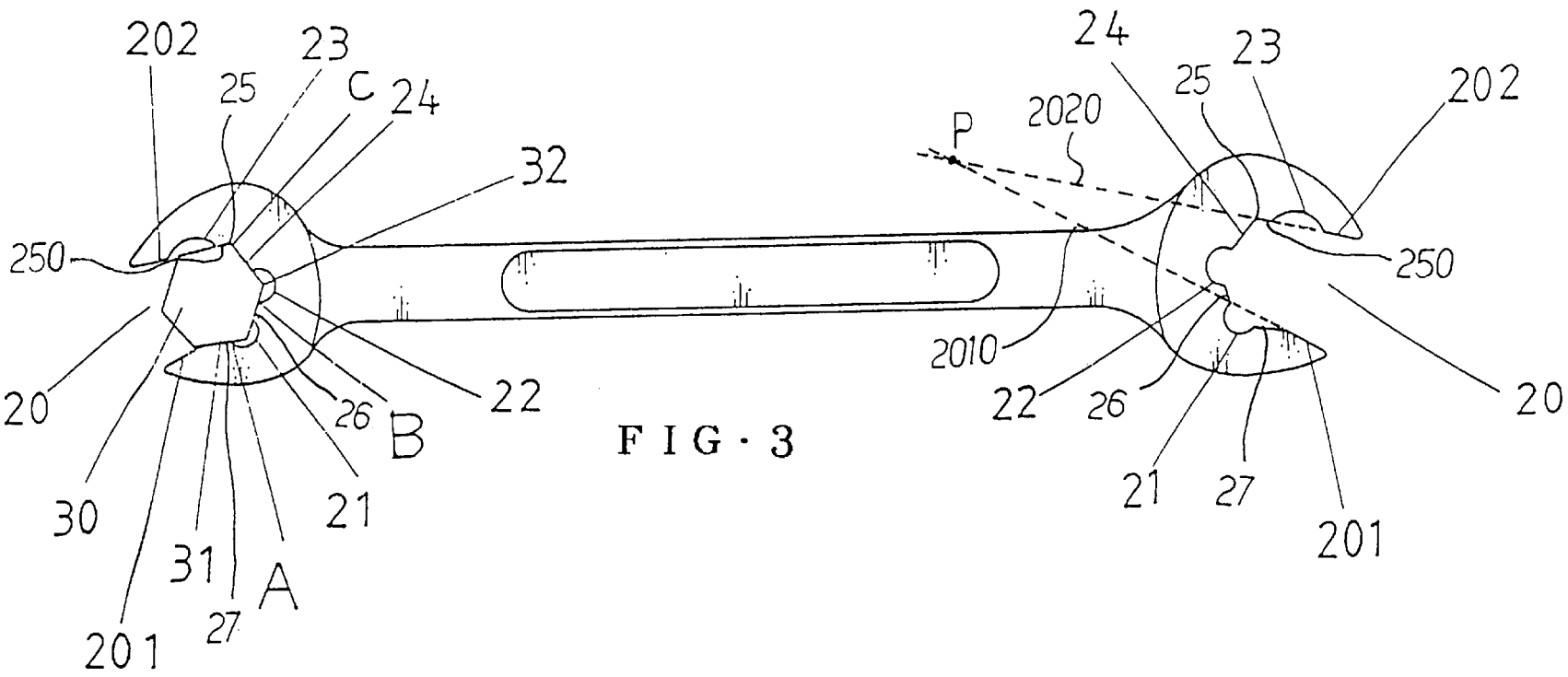
FIG. 3 is a plan view to show the speed wrench of the present invention.

Referring to FIGS. 2 and 3, the speed wrench in accordance with the present invention comprises a shank having two open ends 20 on two ends of the shank. Each open end 20 has a throat portion 200 connected to the shank and a first jaw and a second jaw respectively extend from the throat portion 200. The first jaw has a first flat surface 201 defined in an inside thereof and the second jaw has a second flat surface 202 defined in an inside thereof, wherein the first flat surface 201 and the second flat surface 202 are not parallel with each other and an imaginary line 2010 extending from the first flat surface 201 intersects an imaginary line 2020 extending from the second flat surface 202 at a point "P" located between the two ends of the shank. This allows the wrench to be reciprocally operated without removing the open end from the object.

A curved throat recess 22 is defined in the portion 200 and located between the first jaw and the second jaw. A curved first recess 21 is defined in the inside of the first jaw and a curved second recess 23 is defined in the inside of the second jaw. An end of a periphery defining the second recess 23 is connected to the second flat surface 202. A first pushing side 27 is connected between the first flat surface 201 and an end of a periphery defining the first recess 21. A second pushing side 26 is connected between an end of a periphery defining the throat recess 22 and the other end of the periphery defining the first recess 21. A third pushing side 24 is defined in the inside of the second jaw and extends from the other end of the periphery defining the throat recess 22. A fourth pushing side 250 is connected between the third pushing side 24 and the other end of the periphery defining the second recess 23. A 60-degree angle 25 is defined between the third pushing side 24 and the fourth pushing side 250. A length of the third pushing side 24 equals to two third of a side of a hexagonal object 30 and a length of the fourth pushing side 250 equals to one third of a side of a hexagonal object 30.

When engaging a hexagonal object 30, two sides "A", "B" of the object 30 are respectively engaged with the first pushing side 27 and the second pushing side 26. Another two sides of the object 30 are engaged with the the third pushing side 24 and the fourth pushing side 250. A peak portion of the object 30 is matched with the 120-degree angle 25. Two peak portions of the object 30 are respectively engaged with the throat recess 22 and the first recess 21. Accordingly, the object 30 is securely engaged with the open end of the speed wrench.

Figure 4:
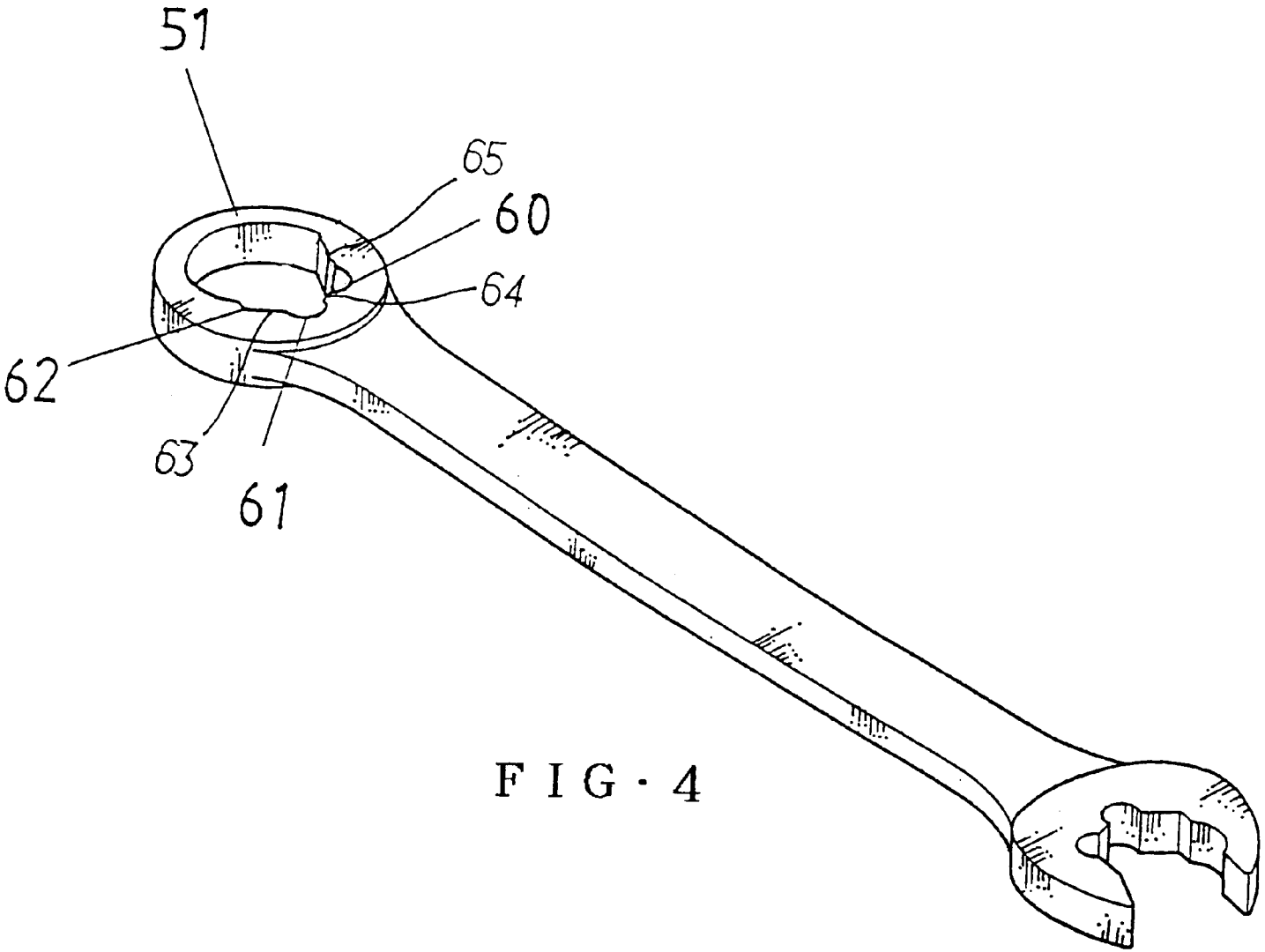
FIG. 4 shows another embodiment of the wrench of the present invention which has a close end and an open end.
Figure 5:
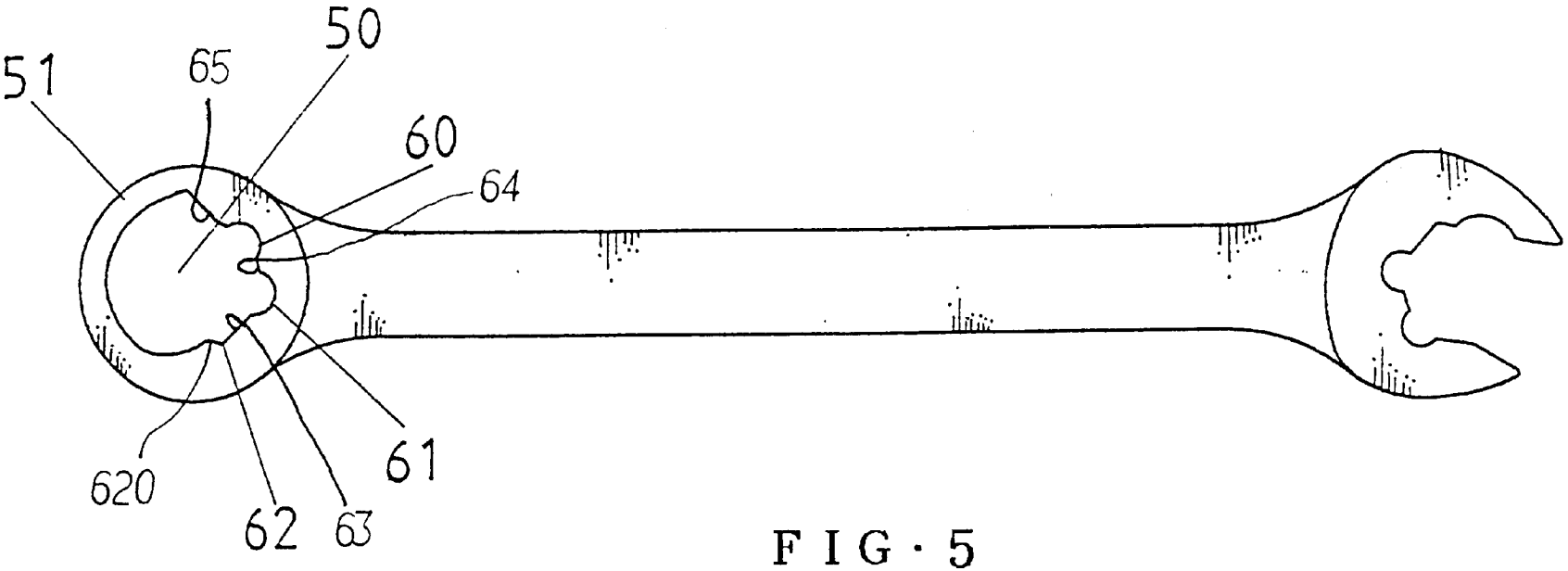
FIG. 5 is a plan view to show the embodiment illustrated in FIG. 4.
Figure 6:
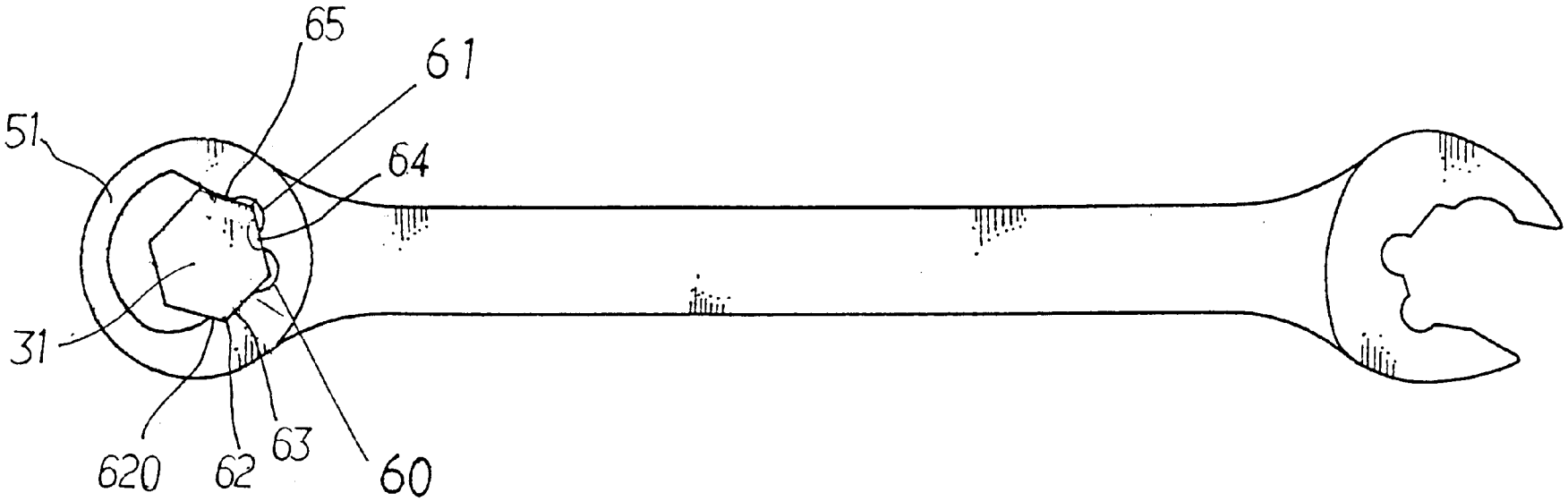
FIG. 6 is a plan view to show a hexagonal object is engaged with the close end of the wrench of the present invention.

FIGS. 4 to 6 show another embodiment of the present invention wherein the shank has an open end and a close end. The close end is derived from the open end and a connection portion 51 is connected between the first flat surface 201 and the second flat surface 202 on the two jaws of the open end to form the close end. A hexagonal object 31 can be engaged with the close end and two sides of the object 31 are respectively engaged with the first pushing side 65 and the second pushing side 64. Another two sides of the object 31 are engaged with the the third pushing side 63 and the fourth pushing side 620. A peak portion of the object 31 is matched with the 120-degree angle 62. Two peak portions of the object 30 are respectively engaged with the throat recess 60 and the first recess 61.

While we have shown and described various embodiments in accordance with the present invention, it should be clear to those skilled in the art that further embodiments may be made without departing from the scope and spirit of the present invention.

What is claimed is:

1. A speed wrench comprising:

a shank having an open end on an end of said shank, said open end having a throat portion connected to said shank and a first jaw and a second jaw respectively extending from said throat portion, said first jaw having a first flat surface defined in an inside thereof and said second jaw having a second flat surface defined in an inside thereof, a throat recess defined in said throat portion and located between said first jaw and said second jaw, a first recess defined in said inside of said first jaw and a second recess defined in said inside of said second jaw, an end of a periphery defining said second recess connected to said second flat surface, a first pushing side connected between said first flat surface and an end of a periphery defining said first recess, a second pushing side connected between an end of a periphery defining said throat recess and the other end of said periphery defining said first recess, a third pushing side defined in said inside of said second jaw and extending from the other end of said periphery defining said throat recess, a fourth pushing side connected between said third pushing side and the other end of said periphery defining said second recess, a 120-degree angle defined between said third pushing side and said fourth pushing side, a length of said third pushing side adapted to be two third of a side of a hexagonal object and a length of said fourth pushing side adapted to be one third of a side of a hexagonal object.

2. The speed wrench as claimed in claim 1, wherein an imaginary line extending from said first flat surface and an imaginary line extending from said second flat surface intersects at a point located between two ends of said shank.

3. The speed wrench as claimed in claim 1 wherein each of said first recess, said second recess and said throat recess is a curved recess.

* * * * *